United States Patent [19]

Pendleton

[11] Patent Number: 4,648,259

[45] Date of Patent: Mar. 10, 1987

[54] ADJUSTABLE NOSE PIECE

[75] Inventor: Richard A. Pendleton, Brockton, Mass.

[73] Assignee: USM Corporation, Farmington, Conn.

[21] Appl. No.: 768,369

[22] Filed: Aug. 22, 1985

[51] Int. Cl.[4] ..... B21J 15/00; B21J 15/32

[52] U.S. Cl. ..... 72/391; 72/465; 279/56

[58] Field of Search ..... 72/391, 453.17, 114, 72/465, 393; 29/243.53; 279/49, 54, 56, 57, 101

[56] References Cited

U.S. PATENT DOCUMENTS

| | | | |
|---|---|---|---|
| 210,075 | 11/1878 | Amidon | 279/56 |
| 2,631,860 | 3/1953 | Bronson | 279/56 |
| 2,829,900 | 4/1958 | Davis | 279/56 |
| 3,657,915 | 4/1972 | Lee | 72/391 |
| 4,059,980 | 11/1977 | Nance | 72/391 |
| 4,350,840 | 9/1982 | Michaels | 279/56 |
| 4,375,760 | 3/1983 | Savage et al. | 72/391 |

*Primary Examiner*—Robert L. Spruill
*Assistant Examiner*—David B. Jones
*Attorney, Agent, or Firm*—Alan N. McCartney

[57] ABSTRACT

A nose piece for properly positioning a member in a tool having a pair of symmetrical opposed nose piece members each of which have a longitudinal groove forming an opening therebetween. The nose piece members have opposed faces, one of which lies on the center line of the members and the other of which is angularly disposed to the center line to form a caming shoulder therebetween about which the members pivot to open and close the opening.

6 Claims, 6 Drawing Figures

ADJUSTABLE NOSE PIECE

BACKGROUND OF THE INVENTION

1. Field of the Invention

This invention relates to a nose piece for a tool which can be easily adjusted to the proper relationship with a member to be received into the nose piece to permit the tool to perform a predetermined desired function on the member.

2. Summary of the Prior Art

In many tools, it is desirable to have a nose piece which has a proper desired relationship with the member adapted to be received through the nose piece so that the tool can properly perform its designed function on the member. One area, for example, in which a nose piece performs this function is on a tool for forming a blind rivet type fastener.

A blind rivet fastener comprises a rivet having an open tubular body with a flanged head. A mandrel stem is inserted through the rivet body with a mandrel head resting against the open end of the rivet body. The rivet body can be inserted into the opening in a workpiece, and by placing the nose piece of a rivet forming tool against the rivet flange and by pulling on the mandrel stem, the rivet body opposite the flange will be deformed by the mandrel head to form a secondary head on the rivet on the blind side of the workpiece. At the completion of the forming of the rivet, the mandrel head can break off from the stem to remain on the blind side of the workpiece to lock the rivet in the workpiece opening. The tools for performing this function can be either manually or power operated. Tools of this type are illustrated in U.S. Pat. Nos. 3,324,700; 3,254,522; and 4,517,820.

The nose piece acts as an anvil on the flange of the rivet against which the pulling force on the mandrel stem reacts during the setting or forming of the rivet. To obtain the required proper axial force on the rivet body when the mandrel stem is pulled, it is necessary that the nose piece react or rest at the juncture of the mandrel stem and the rivet flange as the stem passes through the rivet flange. If the nose piece is spaced from the juncture of the flange and stem, distorted non-axial forces would act on the rivet body. This could result in the mandrel head being pulled entirely through the rivet body destroying the attachment of the rivet in the workpiece opening. Further, if the nose piece is not at the mandrel stem-rivet flange juncture, the mandrel stem could be pulled at an angle to the rivet body axis resulting in an asymmetrical forming of the secondary head leaving a poor connection.

Since the rivet bodies and mandrel stems come in different diameters for use in various size workpiece openings, it has been found desirable in the past to supply the tools with different size nose pieces which can be substituted to accommodate the various sizes of rivets. U.S. Pat. Nos. 3,324,700 and 3,334,509 illustrate rivet setting tools having various sizes of nose pieces. These tools, however, require interchanging the nose piece to accommodate the size of the rivet being used. It is, therefore, desirable to have a single adjustable nose piece which can be easily varied in opening size to accommodate various size blind rivets.

SUMMARY OF THE INVENTION

It is an object of this invention to provide a nose piece for a tool adapted to act on a member, the nose piece being adjustable to accommodate the size of the member so that the desired predetermined function can be performed on the member by the tool.

It is also an object of this invention to provide a permanent nose piece for a blind rivet setting tool which can be adjusted in opening size to accommodate various size rivet mandrels, and assure that the nose piece acts as an anvil at the juncture of the mandrel stem and rivet flange when the mandrel stem is pulled to assure proper setting of the rivet.

It is a further object of this invention to provide a nose piece having symmetrical opposed nose piece members having axial grooves facing one another forming an opening to receive a mandrel stem. The nose piece members each have an upper outer arcuate surface merging into a lower tapered shaped extension and an upper inner flat surface axially disposed to the center line of the arcuate surface and a lower inner flat surface angularly disposed to the center line of the arcuate surface. The upper end of the nose piece members each have angularly disposed surfaces merging into a shoulder adapted to act against the end of the forming tool. A threaded collar is received over the end of the tool and has a circular opening receiving the tapered shaped extensions of the nose piece members. A resilient O-ring rests in grooves formed in the arcuate surface of the nose piece members and biases the nose piece members together so that the upper inner flat surfaces of the nose piece members abut. As the collar is threaded onto the end of the tool, the collar opening will act against the tapered shaped extensions of the nose piece members, forcing the shoulders against the end of the tool causing the nose piece members to cam about the juncture of the upper and lower inner flat surfaces (against the bias of the O-ring) to alter the angular disposition of the nose piece members with respect to one another to open and close the opening between the nose pieces.

DESCRIPTION OF THE PREFERRED EMBODIMENT

The adjustable nose piece of this invention is illustrated in the environment of acting as an anvil for a tool for setting blind rivets. It will become apparent, however, that the nose piece can be utilized with other tools wherein it is desirable to properly position a member acted on by the tool to permit the tool to properly perform its function on the member.

Figure 1:
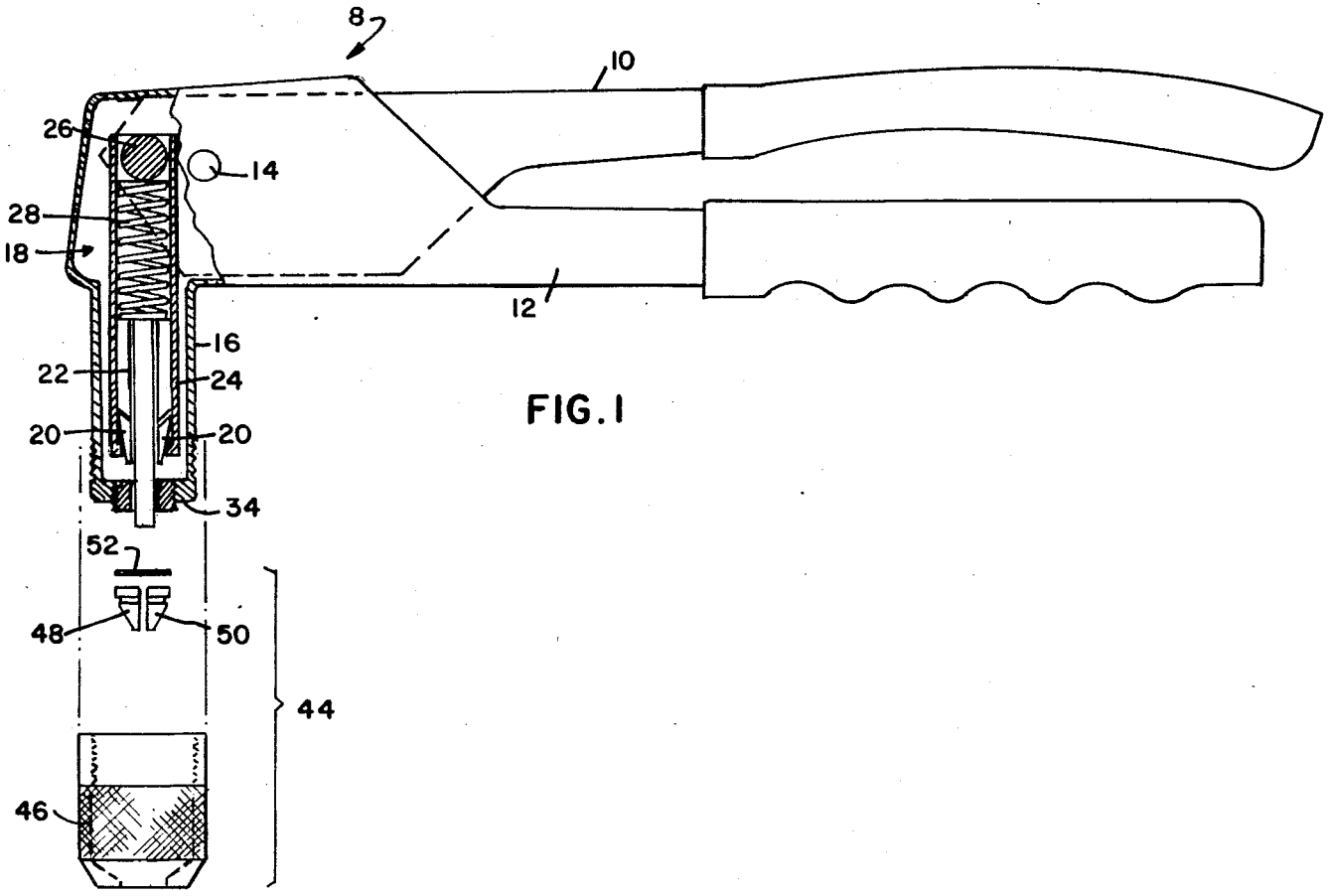
FIG. 1 is an exploded view illustrating the nose piece of this invention as applied to a blind rivet setting tool which is shown partially in section.

The blind rivet setting or forming tool 8, illustrated in FIG. 1, comprises a pair of handles 10, 12 pivoted together at 14. The handle 12 has a tubular housing 16 containing the mandrel pulling mechanism 18. This mechanism generally comprises a pair of jaws 20 and a spring biased jaw pusher 22 enclosed in a jaw puller 24 which is pivoted to cross pin 26 carried in handle 10. The spring 28 acts between the pin 26 and the jaw pusher 22 to bias the jaws 20 to an open condition. The stem 30 (FIGS. 2 and 3) of the mandrel 32 is adapted to be gripped by the jaws 20. By separating the handles 10, 12, the spring 28 forces jaw pusher 22 against the jaws 20 to open the jaws for receipt of the mandrel stem 30. As the handles 10, 12 are pivoted closed, the jaw puller 24 forces the jaws 20 closed about the mandrel stem 30. The end 34 of the tubular housing 16 would normally have the required size nose piece (not shown) acting as an anvil against flange 36 of rivet 38. As the jaws 20 grip the mandrel stem 30 and upon the pulling of the mandrel stem 30 as the handles 10, 12 are pivoted closed, the head end 40 of the mandrel stem 30 will upset the open end 42 of the rivet body to form a secondary head on the rivet on the blind side of a workpiece. This manner of forming a blind rivet is diclosed in U.S. Pat. No. 3,324,700.

In the forming of blind rivets, it is necessary that axial forces act on the rivet body to assure the mandrel head applies uniform force on the body to prevent distortion of the body during forming. To this end, it is desirable that the nose piece of the tool act uniformly about the surface of the rivet flange and at the juncture of the mandrel stem and the flange. In the past, this has been accomplished by having a variety of different size nose pieces which have different opening sizes to accommodate the diameter of the mandrel stem for a particular size rivet. These nose pieces were separate members which could be threaded into the end of the tubular sleeve of the tool.

To eliminate the necessity of removing and inserting different size nose pieces to accommodate the various size rivets, this invention provides an infinitively variable size nose piece (within given size openings) to accommodate the various size mandrel stems and assure the nose piece acts at the juncture of the mandrel stem and the rivet flange.

Figure 5:
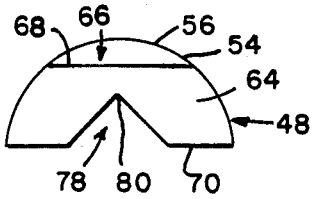
FIG. 5 is a top plan view of an individual nose piece member.
Figure 4:
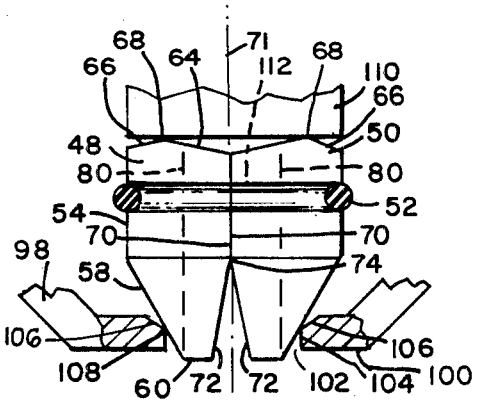
FIG. 4 is an enlarged view of the nose piece members illustrating the contact points between the nose piece members and the collar, and the nose piece members and the insert in the tubular housing of the tool.
Figure 6:
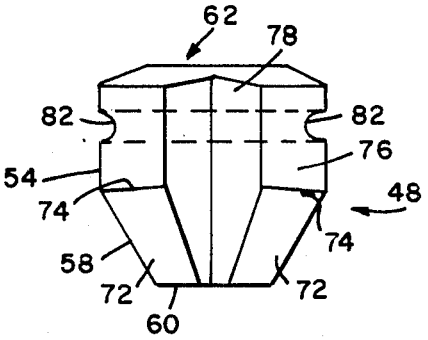
FIG. 6 is a front view of an individual nose piece member.

The nose piece 44 comprises a collar 46, a pair of symmetrical nose piece members 48, 50 and a resilient O-ring 52. The members 48, 50 are identical and only one such member (48) will be described in detail (See FIGS. 4 to 6). The member 48 comprises an upper main body portion 54 which is semi-cylindrical with an arcuate outer surface 56. The surface 56 merges into a lower tapered shaped extension 58 terminating in a semicircular flat surface 60. The upper end 62 of each member 48, 50 has angularly disposed flat surfaces 64, 66 merging into a shoulder 68 extending across the end 62 of each member 48, 50 (See FIGS. 5 and 6). The surface opposite arcuate outer surface 56 is a flat face 70 disposed on the center line 71 of the arcuate outer surface 56. A lower inner flat face 72 is angularly disposed to the center line 71 and is opposite the tapered shaped extension 58. The flat faces 70 and 72 merge into a shoulder 74 extending across the inner surface 76 of the members 48, 50. A groove 78 extends through the inner surface 76 of each of the members 48, 50. The bottom 80 of each groove 78 lies on the center line 71. An arcuate groove 82 extends into the arcuate surface 56 of each member 48, 50 and is adapted to receive a resilient O-ring 52 which biases the flat faces 70 of the members 48, 50 together (See FIG. 4).

The collar 46 has an open cylindrical upper portion 84 in threaded engagement at 86 with the tubular housing 16 of the tool 8. A snap ring 88 is positioned in the cylindrical portion 84 and engages the shoulder 90 of the tubular housing 16 to secure the collar 46 on tubular housing 16 and to limit the outward position of collar 46. The shoulder 92 on the inner surface 94 of collar 46 contacts the end 34 of the tubular housing 16 to limit the inward movement of the collar during adjustment. The end 98 of the collar 46 has a circular flat face 100 with an opening 102 for receipt of the nose piece members 48, 50. The annular opening 102 has an outward annular surface 104 on the center line 71 and an inwardly flaired annular surface 106 disposed at an angle to the center line 71 (See FIG. 4). With the surface 106 disposed at a greater angle to center line 71 than the angular disposition of tapered surface 58 to the center line 71, the surfaces 104, 106 merge into an annular shoulder 108 which contacts the tapered surface 58 (See FIG. 4). The tubular housing 16 has a threaded insert 110.

Figure 2:
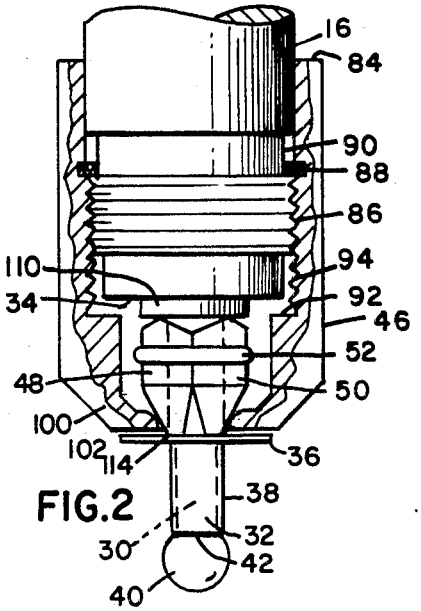
FIG. 2 is an illustration of the nose piece in the open position of adjustment.
Figure 3:
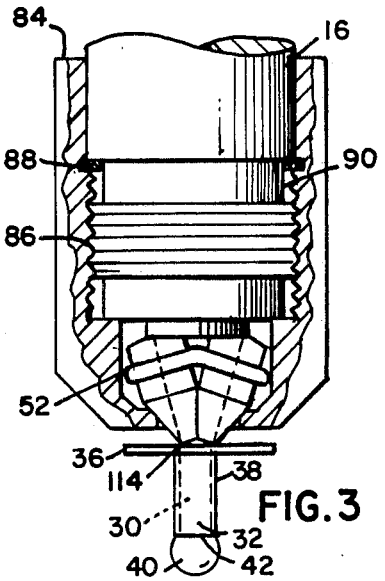
FIG. 3 is an illustration of the nose piece in the closed position of adjustment.

Attention is now directed to FIGS. 2 and 3 which illustrate the operation of the nose piece of this invention as an anvil during the forming of a blind rivet type fastener. The mandrel stem 30 is inserted into the opening 112 formed by grooves 78 of members 48, 50. At this point, the shoulder 68 of members 48, 50 will be in contact with the insert 110. The annular shoulder 108 of opening 102 will contact the tapered extension 58 of each member 48, 50. The O-ring will bias the members 48 together to engage the flat faces 70. Further, the tapered extension 58 extends beyond the end 98 of collar 46 so that the surfaces 60 will contact the flange 36 of the rivet 38. As the collar 46 is threaded onto, the tubular housing 16 (See FIG. 3), the annular shoulder 108 of opening 102 will be forced against the tapered surfaces 58 and force the members 48, 50 to pivot about the fulcrum formed by coacting shoulders 74. Since the distance between the annular shoulder 108 and the center line 71 is less than the distance of the shoulders 68 from the center line 71, the upward force will cause the members 48, 50 to pivot along the line contact of shoulders 74 against the bias of the O-ring 52. During this adjustment, the shoulders 68 will move outwardly and the opening 112 will be reduced (See FIG. 2) to the desired size for the mandrel of the rivet being formed. In this manner, flat surface 60 of the nose piece members 48, 50 will be positioned adjacent the juncture 114 of the mandrel stem 30 and the rivet flange 36, as illustrated in FIG. 2.

From the above description, it can be seen that an automatically adjustable nose piece has been provided that will properly align and position a member received into a tool for performing a desired function on the member.

I claim:

1. A nose piece adapted to be received against the end of a housing of a tool for properly aligning and positioning a fastener with respect to a tool so that the tool can properly perform a desired function with respect to the fastener, comprising:

(a) a pair of substantially symmetrical members each having a main body portion and a tapered outer extension;

(b) said main body portions of each of said members having opposed ends, one of which is provided with a shoulder contacting the end of the tool housing;

(c) said body portions of each of said members having angularly disposed inner faces merging into a camming surface;

(d) said members each having grooves throughout their longitudinal extent presenting an opening for receipt of the fastener upon which the tool will perform a function;

(e) means surrounding said members biasing said members toward one another; and (f) means comprising a collar having an opening with a surface for contacting said tapered outer extensions causing said members to pivot about said camming surface against the action of said biasing means to open and close said opening; said biasing means being located on the side of said camming means opposite said tapered outer extension to retain the opening size in a fixed adjusted dimension.

2. The nose piece of claim 1, wherein said members are positioned along a center line and the point of contact of said contacting means with said tapered extensions is closer to said center line than said shoulder is to said center line.

3. The nose piece of claim 1, wherein said caming shoulder is located at the juncture of said main body portion and said tapered extension.

4. The nose piece of claim 1, wherein said biasing means is a resilient O-ring positioned in grooves in said main body portion.

5. The nose piece of claim 1, wherein said main body portion is an arcuate configuration and said tapered extension is a semi-truncated configuration.

6. The nose piece of claim 2, wherein said angularly disposed faces of said members comprise a pair of faces one of which lies along said center line and the other is disposed at an angle to said center line.

* * * * *